US010815813B2

(12) United States Patent
Blaney et al.

(10) Patent No.: US 10,815,813 B2
(45) Date of Patent: Oct. 27, 2020

(54) GAS TURBINE RAPID RESPONSE CLEARANCE CONTROL SYSTEM WITH ANNULAR PISTON

(71) Applicant: United Technologies Corporation, Hartford, CT (US)

(72) Inventors: Ken F. Blaney, Middleton, NH (US); Christopher M. Jarochym, Ogunquit, ME (US)

(73) Assignee: Raytheon Technologies Corporation, Farmington, CT (US)

( * ) Notice: Subject to any disclaimer, the term of this patent is extended or adjusted under 35 U.S.C. 154(b) by 699 days.

(21) Appl. No.: 14/903,836

(22) PCT Filed: May 9, 2014

(86) PCT No.: PCT/US2014/037420

§ 371 (c)(1),
(2) Date: Jan. 8, 2016

(87) PCT Pub. No.: WO2015/020708

PCT Pub. Date: Feb. 12, 2015

(65) Prior Publication Data

US 2016/0369644 A1 Dec. 22, 2016

Related U.S. Application Data

(60) Provisional application No. 61/845,196, filed on Jul. 11, 2013.

(51) Int. Cl.
*F01D 11/20* (2006.01)
*F01D 25/24* (2006.01)
(Continued)

(52) U.S. Cl.
CPC ..... *F01D 11/20* (2013.01); *F01D 5/02* (2013.01); *F01D 5/12* (2013.01); *F01D 11/22* (2013.01);
(Continued)

(58) Field of Classification Search
CPC . F01D 11/20; F01D 11/22; F01D 5/02; F01D 5/12; F01D 11/14; F04D 27/002
See application file for complete search history.

(56) References Cited

U.S. PATENT DOCUMENTS 2,412,365 A * 12/1946 Sollinger ..... F01D 17/162 415/160
3,085,398 A * 4/1963 Ingleson ..... F01D 11/22 415/127
(Continued)

FOREIGN PATENT DOCUMENTS

GB 2099515 A 12/1982

OTHER PUBLICATIONS

EP search report for EP14835039.0 dated Jul. 12, 2016.

*Primary Examiner* — Kenneth Bomberg
*Assistant Examiner* — Michael L Sehn
(74) *Attorney, Agent, or Firm* — Getz Balich LLC

(57) ABSTRACT

An active clearance control system for a gas turbine engine includes an annular piston with a multiple of piston lift lugs. A method of active blade tip clearance control for a gas turbine engine includes translating axial movement of an annular piston to radial movement of a multiple of blade outer air seal segments.

16 Claims, 11 Drawing Sheets

(51) Int. Cl.

| | |
|---|---|
| ***F01D 11/22*** | (2006.01) |
| ***F01D 5/02*** | (2006.01) |
| ***F01D 5/12*** | (2006.01) |
| ***F04D 27/00*** | (2006.01) |
| ***F04D 29/16*** | (2006.01) |
| ***F04D 29/32*** | (2006.01) |

(52) U.S. Cl.
CPC ..... *F01D 25/246* (2013.01); *F04D 27/002* (2013.01); *F04D 29/164* (2013.01); *F04D 29/324* (2013.01); *F05D 2220/32* (2013.01); *F05D 2240/11* (2013.01); *F05D 2250/232* (2013.01); *F05D 2260/56* (2013.01); *F05D 2260/57* (2013.01); *F05D 2270/64* (2013.01); *F05D 2270/65* (2013.01)

(56) References Cited

U.S. PATENT DOCUMENTS

| | | | | |
|---|---|---|---|---|
| 4,330,234 | A | 5/1982 | Colley | |
| 4,844,688 | A * | 7/1989 | Clough | F01D 11/22 415/116 |
| 5,096,375 | A | 3/1992 | Ciokailo | |
| 5,203,673 | A | 4/1993 | Evans | |
| 5,228,828 | A | 7/1993 | Damlis et al. | |
| 7,874,793 | B2 | 1/2011 | Razzell et al. | |
| 8,534,996 | B1 * | 9/2013 | Pankey | F01D 11/22 415/127 |
| 2002/0150469 | A1 | 10/2002 | Bolms | |
| 2011/0318162 | A1 * | 12/2011 | Cottrell | F01D 25/04 415/13 |
| 2012/0057958 | A1 * | 3/2012 | Klingels | F01D 11/22 415/1 |

* cited by examiner

GAS TURBINE RAPID RESPONSE CLEARANCE CONTROL SYSTEM WITH ANNULAR PISTON

CROSS-REFERENCE TO RELATED APPLICATIONS

This application claims priority to PCT Patent Appln. Serial No. PCT/US14/037420 filed May 9, 2014, which claims priority to U.S. Patent Appln. Ser. No. 61/845,196 filed Jul. 11, 2013, which is hereby incorporated herein by reference in their entireties.

STATEMENT REGARDING FEDERALLY SPONSORED RESEARCH OR DEVELOPMENT

This disclosure was made with Government support under FA-8650-09-D-2923 0021 awarded by the United States Air Force. The Government may have certain rights in this disclosure.

BACKGROUND

The present disclosure relates to a gas turbine engine and, more particularly, to a blade tip rapid response active clearance control (RRACC) system therefor.

Gas turbine engines, such as those that power modem commercial and military aircraft, generally include a compressor to pressurize an airflow, a combustor to burn a hydrocarbon fuel in the presence of the pressurized air, and a turbine to extract energy from the resultant combustion gases. The compressor and turbine sections include rotatable blade arrays and stationary vane arrays. Within an engine case structure, the radial outermost tips of each blade array are positioned in close proximity to a shroud assembly. Blade outer air seal segments (BOAS) supported by the shroud assembly are located adjacent to the blade tips such that a radial tip clearance is defined therebetween.

When in operation, the engine thermal environment varies such that the radial tip clearance varies. The radial tip clearance is typically designed so that the blade tips do not rub against the BOAS under high power operations when the blade disk and blades expand as a result of thermal expansion and centrifugal loads. When engine power is reduced, the radial tip clearance increases. To facilitate engine performance, it is operationally advantageous to maintain a close radial tip clearance through the various engine operational conditions.

SUMMARY

An active clearance control system for a gas turbine engine according to one disclosed non-limiting embodiment of the present disclosure includes an annular piston with a multiple of piston lift lugs.

In a further embodiment of the present disclosure, the annular piston is defined about an axis, and the multiple of piston lift lugs extend from the annular piston toward the axis.

In a further embodiment of any of the foregoing embodiments of the present disclosure, a multiple of blade outer air seal segments are included. Each of the multiple of piston lift lugs is engaged with one of the multiple of blade outer air seal segments.

In a further embodiment of any of the foregoing embodiments of the present disclosure, the multiple of piston lift lugs translate axial movement of the annular piston to radial movement of the multiple of blade outer air seal segments.

In a further embodiment of any of the foregoing embodiments of the present disclosure, each of the multiple of blade outer air seal segments include a blade outer air seal lift lug engaged with one of the multiple of piston lift lugs at a ramped interface.

In a further embodiment of any of the foregoing embodiments of the present disclosure, each of the multiple of blade outer air seal segments includes a blade outer air seal lift lug engaged with one of the multiple of piston lift lugs through a link.

In a further embodiment of any of the foregoing embodiments of the present disclosure, a full-hoop mount ring is included that contains the annular piston.

In a further embodiment of any of the foregoing embodiments of the present disclosure, a multiple of annular piston ring seals are included mounted to the annular piston to seal the annular piston within the full-hoop mount ring.

In a further embodiment of any of the foregoing embodiments of the present disclosure, the annular piston includes a multiple of piston faces.

In a further embodiment of any of the foregoing embodiments of the present disclosure, the multiple of piston faces includes a first piston face, a second piston face and a third piston face, where at least one piston face pass thru in the first piston face and the second piston face.

In a further embodiment of any of the foregoing embodiments of the present disclosure, the first piston face, the second piston face and the third piston face are sealed by the multiple of annular piston ring seals.

In a further embodiment of any of the foregoing embodiments of the present disclosure, the full-hoop mount ring supports a multiple of blade outer air seal segments.

In a further embodiment of any of the foregoing embodiments of the present disclosure, each of the multiple of blade outer air seal segments includes a lift lug engaged with one of the multiple of piston lift lugs.

In a further embodiment of any of the foregoing embodiments of the present disclosure, each of the multiple of blade outer air seal segments includes a forward hook and an aft hook which respectively cooperate with a forward hook and an aft hook of the full-hoop mount ring.

In a further embodiment of any of the foregoing embodiments of the present disclosure, the lift lug is located axially between the forward hook and the aft hook of each of the multiple of blade outer air seal segments.

In a further embodiment of any of the foregoing embodiments of the present disclosure, a pneumatic subsystem is in communication with the full-hoop mount ring thru a three-way valve to operate the annular piston in response to a control subsystem.

A method of active blade tip clearance control for a gas turbine engine according to another disclosed non-limiting embodiment of the present disclosure includes translating axial movement of an annular piston to radial movement of a multiple of blade outer air seal segments.

In a further embodiment of any of the foregoing embodiments of the present disclosure, the method includes lifting the multiple of blade outer air seal segments with a ramp interface between a multiple of piston lift lugs that radially extend from the annular piston and a lift lug on each of the multiple of blade outer air seal segments.

In a further embodiment of any of the foregoing embodiments of the present disclosure, the method includes supporting each of the multiple of blade outer air seal segments with a full-hoop mount ring that contains the annular piston.

In a further embodiment of any of the foregoing embodiments of the present disclosure, the method includes pneumatically pressurizing the full-hoop mount ring to drive the annular piston and lift the multiple of blade outer air seal segments.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

Various features will become apparent to those skilled in the art from the following detailed description of the disclosed non-limiting embodiments. The drawings that accompany the detailed description can be briefly described as follows.

DETAILED DESCRIPTION

Figure 1:
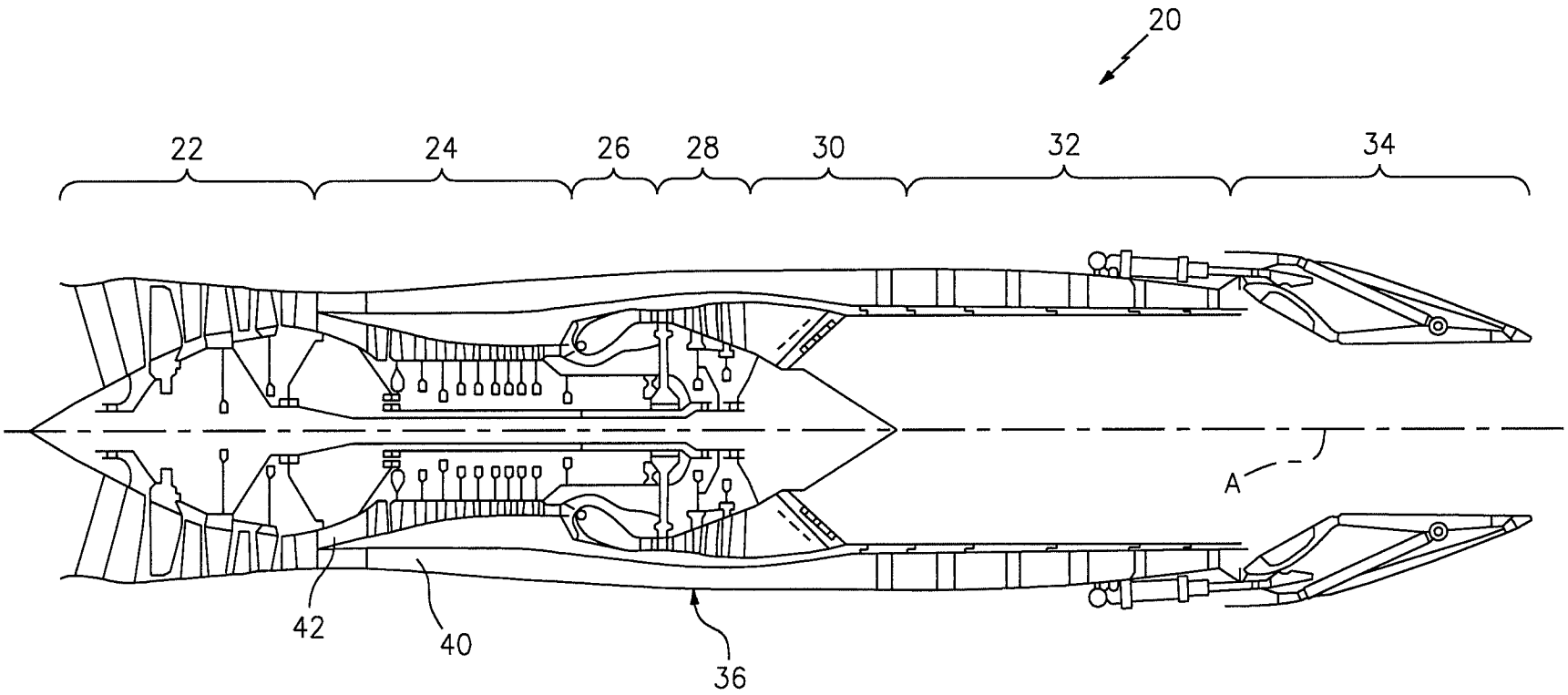
FIG. 1 is a schematic cross-section of one example aero gas turbine engine.

FIG. 1 schematically illustrates a gas turbine engine 20. The gas turbine engine 20 is disclosed herein as a two-spool low-bypass augmented turbofan that generally incorporates a fan section 22, a compressor section 24, a combustor section 26, a turbine section 28, an augmenter section 30, an exhaust duct section 32, and a nozzle system 34 along a central longitudinal engine axis A. Although depicted as an augmented low bypass turbofan in the disclosed non-limiting embodiment, it should be understood that the concepts described herein are applicable to other gas turbine engines including non-augmented engines, geared architecture engines, direct drive turbofans, turbojet, turboshaft, multi-stream variable cycle adaptive engines and other engine architectures. Variable cycle gas turbine engines power aircraft over a range of operating conditions and essentially alters a bypass ratio during flight to achieve countervailing objectives such as high specific thrust for high-energy maneuvers yet optimizes fuel efficiency for cruise and loiter operational modes.

An engine case structure 36 defines a generally annular secondary airflow path 40 around a core airflow path 42. Various case structures and modules may define the engine case structure 36 which essentially defines an exoskeleton to support the rotational hardware.

Air that enters the fan section 22 is divided between a core airflow through the core airflow path 42 and a secondary airflow through a secondary airflow path 40. The core airflow passes through the combustor section 26, the turbine section 28, then the augmentor section 30 where fuel may be selectively injected and burned to generate additional thrust through the nozzle system 34. It should be appreciated that additional airflow streams such as third stream airflow typical of variable cycle engine architectures may additionally be sourced from the fan section 22.

The secondary airflow may be utilized for a multiple of purposes to include, for example, cooling and pressurization. The secondary airflow as defined herein may be any airflow different from the core airflow. The secondary airflow may ultimately be at least partially injected into the core airflow path 42 adjacent to the exhaust duct section 32 and the nozzle system 34.

The exhaust duct section 32 may be circular in cross-section as typical of an axisymmetric augmented low bypass turbofan or may be non-axisymmetric in cross-section to include, but not be limited to, a serpentine shape to block direct view to the turbine section 28. In addition to the various cross-sections and the various longitudinal shapes, the exhaust duct section 32 may terminate in a Convergent/Divergent (C/D) nozzle system, a non-axisymmetric two-dimensional (2D) C/D vectorable nozzle system, a flattened slot nozzle of high aspect ratio or other nozzle arrangement.

Figure 2:
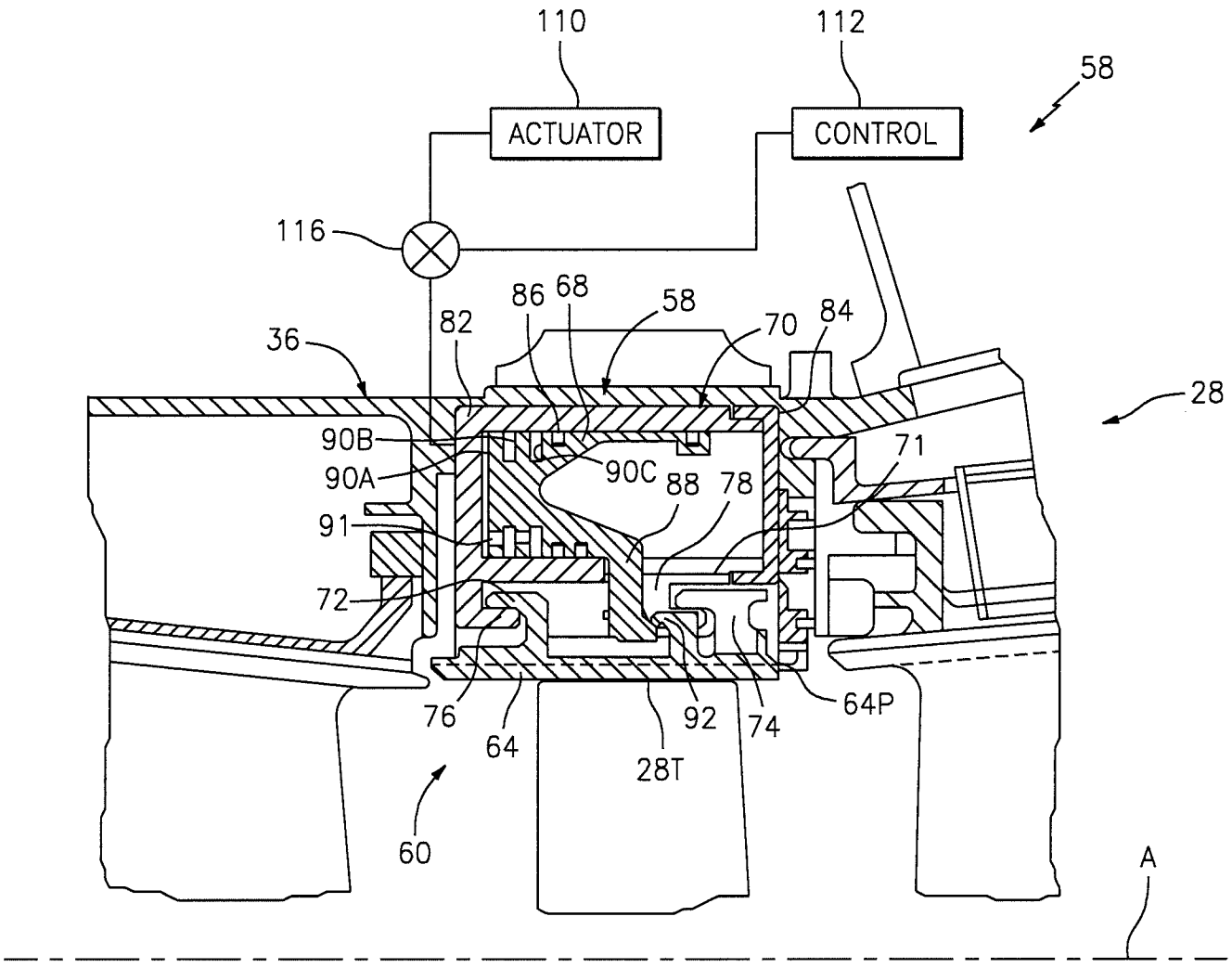
FIG. 2 is an enlarged partial sectional schematic view of a portion of a rapid response active clearance control system according to one disclosed non-limiting embodiment.

With reference to FIG. 2, a blade tip rapid response active clearance control (RRACC) system 58 includes a radially adjustable Blade Outer Air Seal (BOAS) system 60 that operates to control blade tip clearances of, for example, the turbine section 28; however, other sections such as the compressor section 24 may also benefit herefrom. The radially adjustable BOAS system 60 may be arranged around each or one or more particular stages within the gas turbine engine 20. That is, each or select rotor stages may have an associated radially adjustable BOAS system 60 of the RRACC system 58.

Figure 3:
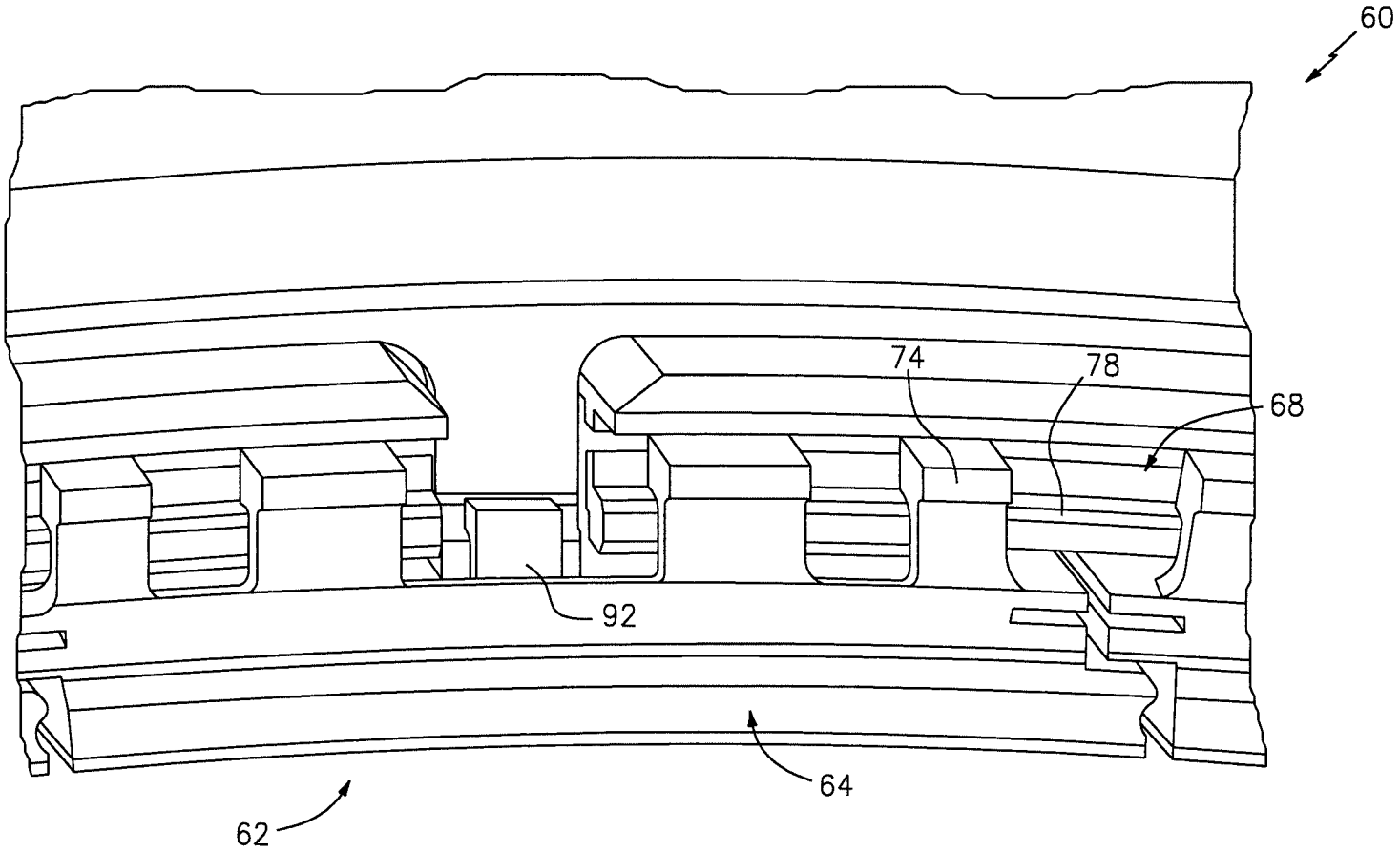
FIG. 3 is a perspective forward view of a circumferential section of an air seal segment of the rapid response active clearance control system.
Figure 4:
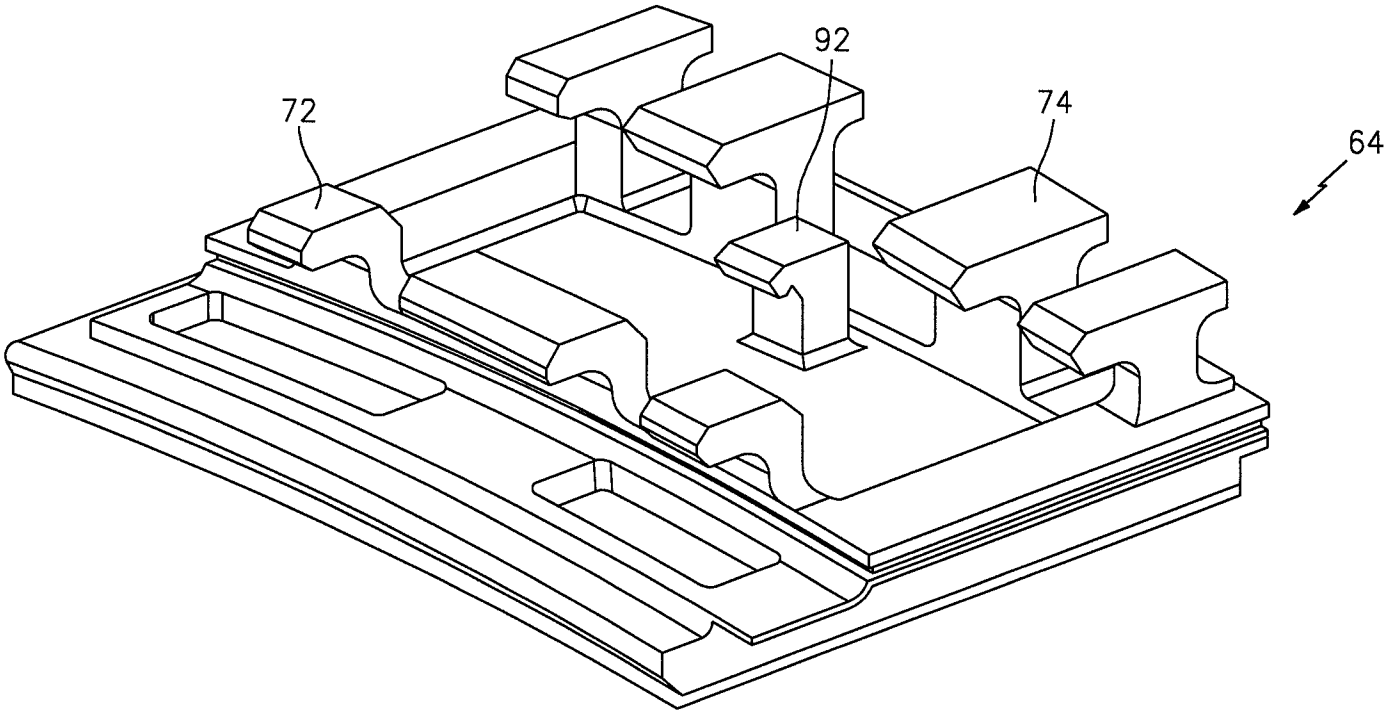
FIG. 4 is an outer perspective view of one of a multiple of air seal segments of the rapid response active clearance control system.
Figure 5:
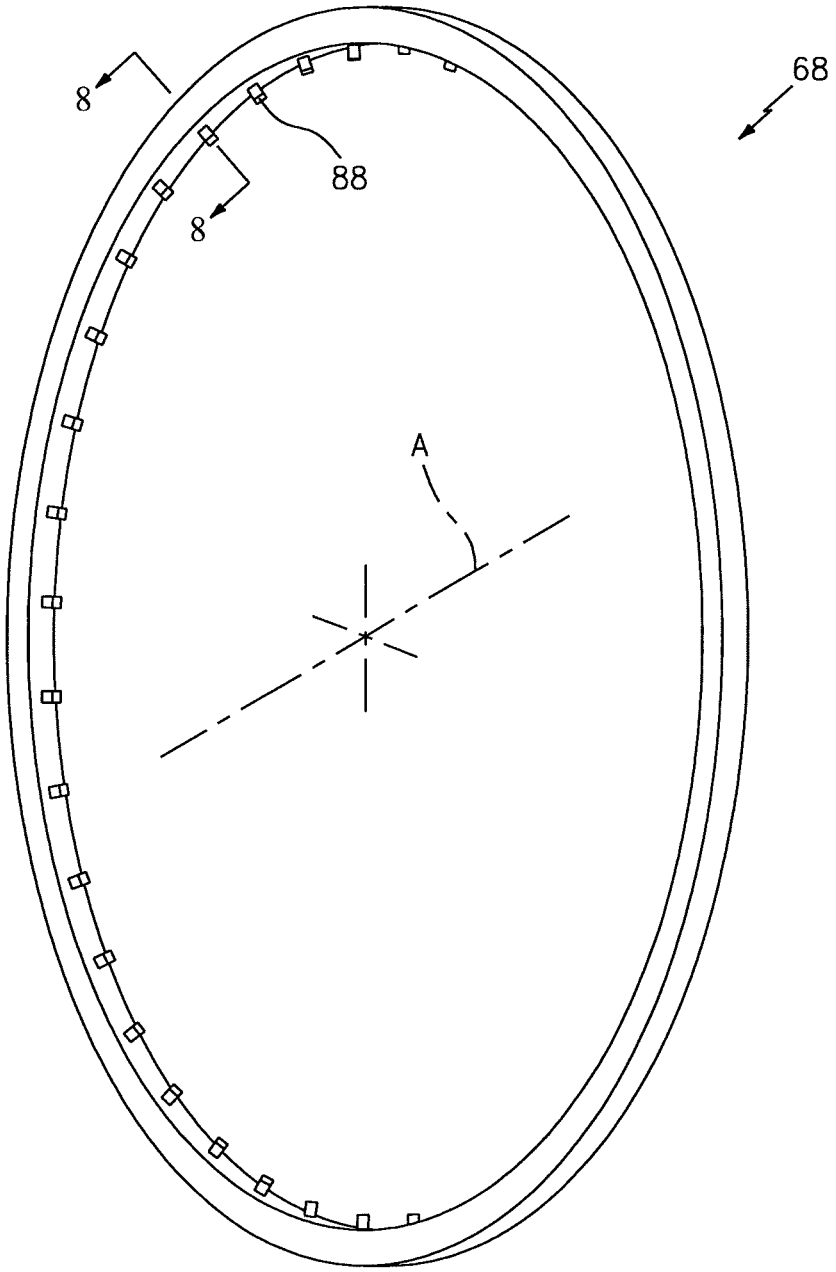
FIG. 5 is a perspective view of an annular piston of the rapid response active clearance control system.

The radially adjustable BOAS system 60 is subdivided into a multiple of circumferential sections 62 (FIG. 3), each with a respective air seal segment 64 (FIG. 4) engageable with an annular piston 68 (FIG. 5). In one disclosed non-limiting embodiment, each air seal segment 64 may extend circumferentially for about nine (9) degrees, be manufactured of an abradable material to accommodate potential interaction with the blade tips 28T and include numerous cooling air passages 64P to permit secondary airflow therethrough.

With continued reference to FIG. 2, each of the multiple of air seal segments 64 is at least partially supported by a generally fixed full-hoop mount ring 70. That is, the full-hoop mount ring 70 is mounted to, or forms a portion of, the engine case structure 36. It should be appreciated that various static structures may additionally or alternatively be provided to at least partially support the multiple of air seal segments 64 yet permit relative radial movement therebetween.

A forward hook 72 and aft hook 74 of each air seal segment 64 respectively cooperates with a forward hook 76 and aft hook 78 of the full-hoop mount ring 70. The hooks 72, 74, 76, 78 may be circumferentially segmented (best seen in FIGS. 3 and 4) or otherwise configured to facilitate assembly. The forward hook 72 may extend axially aft and the aft hook 74 may extend axially forward, vice-versa, both may extend axially forward (shown) or both may extends axially aft within the engine to engage the reciprocally directed forward hook 76 and aft hook 78 of the full-hoop mount ring 70.

Figure 6:
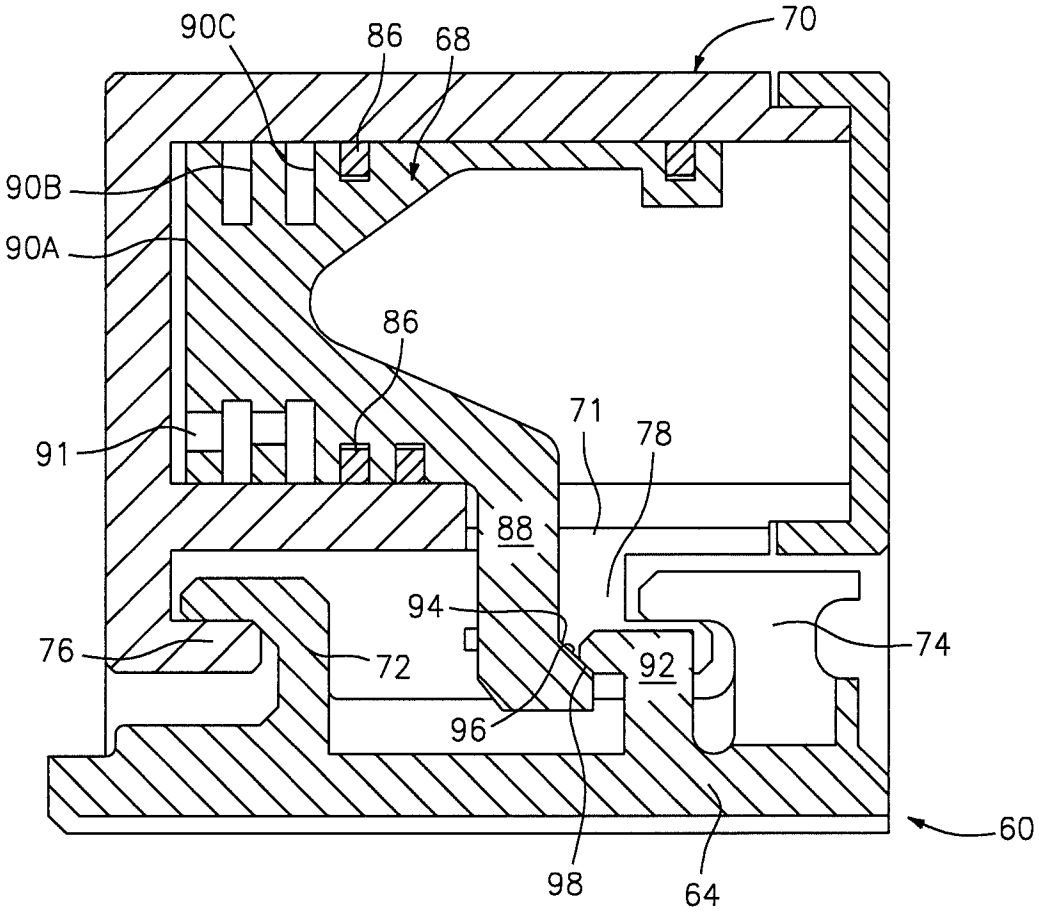
FIG. 6 is an enlarged partial sectional schematic view of one of a multiple of air seal segments of the rapid response active clearance control system in a radially contracted blade outer air seal position.
Figure 7:
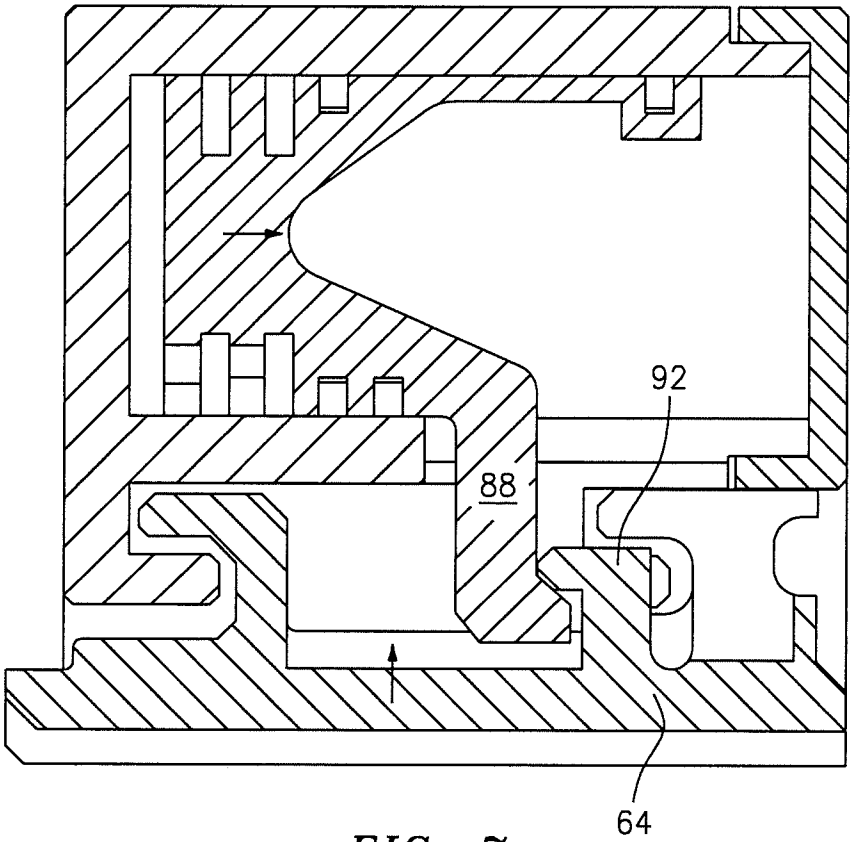
FIG. 7 is an enlarged partial sectional schematic view of one of a multiple of air seal segments of the rapid response active clearance control system in a radially expanded blade outer air seal position.

With continued reference to FIG. 2, each air seal segment 64 is radially movable between a radially contracted BOAS position (see FIG. 6) and a radially expanded BOAS position (see FIG. 7). The annular piston 68 need only "pull" each associated air seal segment 64 as a differential pressure from the core airflow biases the air seal segment 64 toward the extended radially contracted BOAS position (see FIG. 6). For example, the differential pressure may exert an about 1000 pound force (454 kilonewtons) inward force on each air seal segment 64.

The annular piston 68 is mounted within the full-hoop mount ring 70 for axial movement therein parallel to the central longitudinal engine axis A. The full-hoop mount ring 70 may be formed of a forward full-hoop mount ring section 82 and an aft full-hoop mount ring section 84 to facilitate enclosure of the annular piston 68 therein. It should be appreciated that various configurations of the full-hoop mount ring 70 may be utilized for enclosure of the annular piston 68 and assembly of the full-hoop mount ring 70 within the engine case structure 36.

With reference to FIG. 6, the annular piston 68 supports a multiple of annular piston ring seals 86 that provide an air seal for the annular piston 68 within the full-hoop mount ring 70. The annular piston ring seals 86 are located upstream of a multiple of radial extending piston lift lugs 88. That is, the multiple of piston lift lugs 88 extend through a slot 71 in the full-hoop mount ring 70 downstream of the multiple of annular piston ring seals 86 at full axial travel of the annular piston 68 (FIG. 7).

Figure 8:
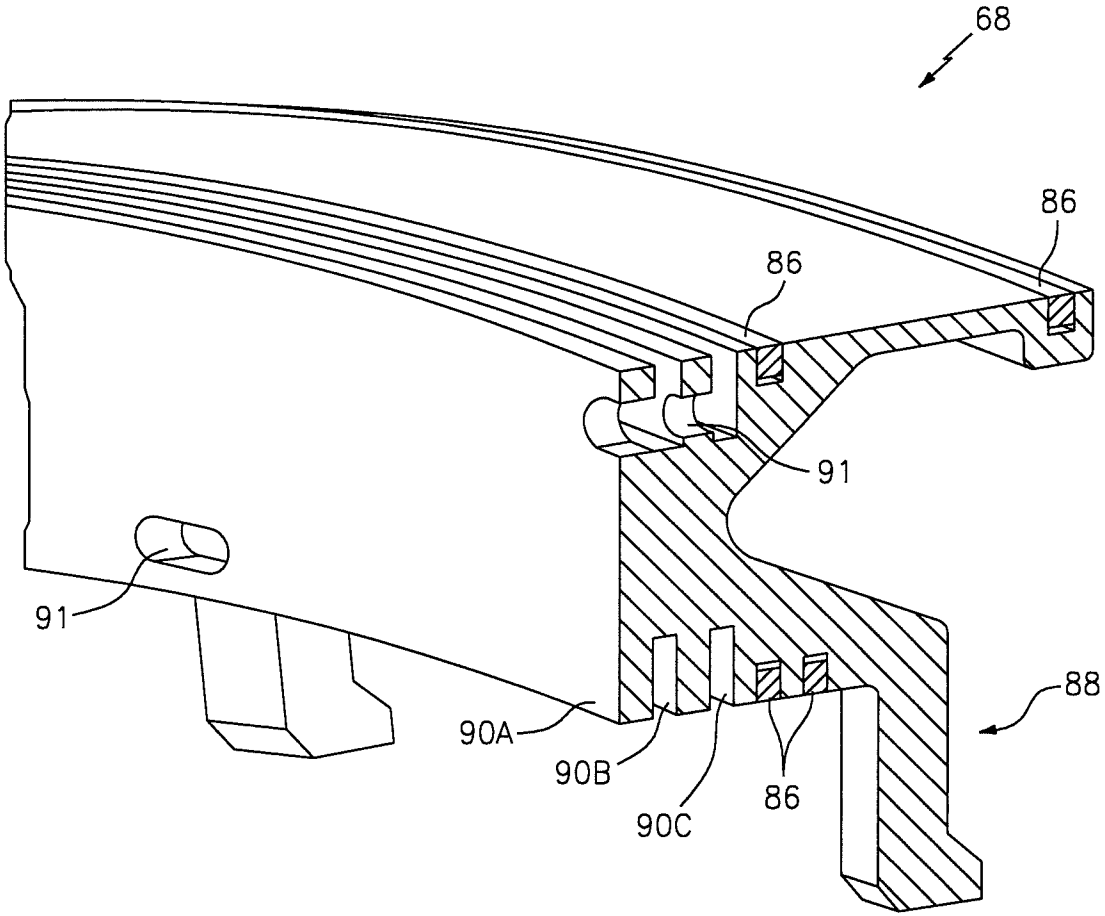
FIG. 8 is a sectional view of annular piston taken along line 8-8 in FIG. 5.

The annular piston 68 may include a multiple of piston faces 90 which, in the disclosed non-limiting embodiment, includes a first piston face 90A, a second piston face 90B and a third piston face 90C. At least one piston face pass thru 91 (also shown in FIG. 8) extends through the first piston face 90A and the second piston face 90B such that air pressure may operate on the first piston face 90A, the second piston face 90B and the third piston face 90C to magnify pneumatic force on the annular piston 68. It should be appreciated that any number of piston faces—including a singular face—may alternatively be provided.

The multiple of piston lift lugs 88 radially extend toward the central longitudinal engine axis A to engage at least one respective blade outer air seal lift lug 92 on each air seal segment 64 at, in the disclosed non-limiting embodiment, a ramped interface 94 therebetween. That is, a ramp surface 96 on the multiple of piston lift lugs 88 interfaces with a ramp surface 98 on the at least one respective blade outer air seal lift lug 92 to define the ramped interface 94 to translate axial movement of the annular piston 68 to radial movement of the multiple of blade outer air seal segments 64.

In one disclosed non-limiting embodiment, the blade outer air seal lift lug 92 is located between the forward hook 72 and the aft hook 74 of each air seal segment 64. Air pressure upon the multiple of piston faces 90A, 90B, 90C drives the annular piston 68 (to the right in the Figures) such that the ramped interface 94 lifts (upward in the Figures) each air seal segment 64 from the radially contracted BOAS position (see FIG. 6) and the radially expanded BOAS position (see FIG. 7).

Figure 9:
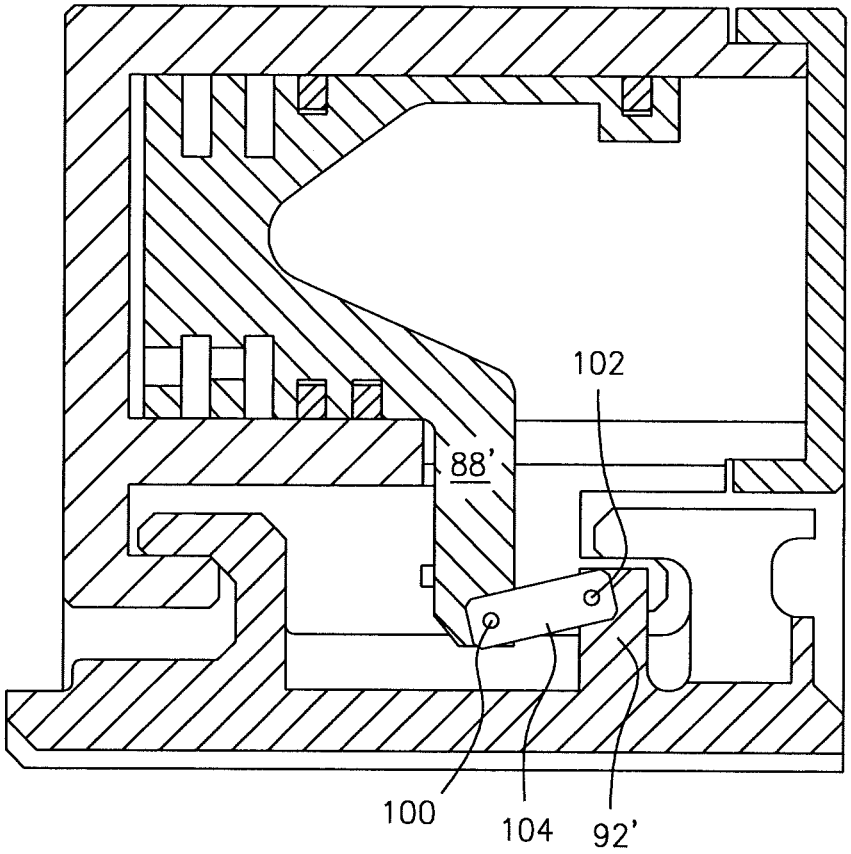
FIG. 9 is an enlarged partial sectional schematic view of one of a multiple of air seal segments of the rapid response active clearance control system according to another disclosed non-limiting embodiment in a radially contracted blade outer air seal position.
Figure 10:
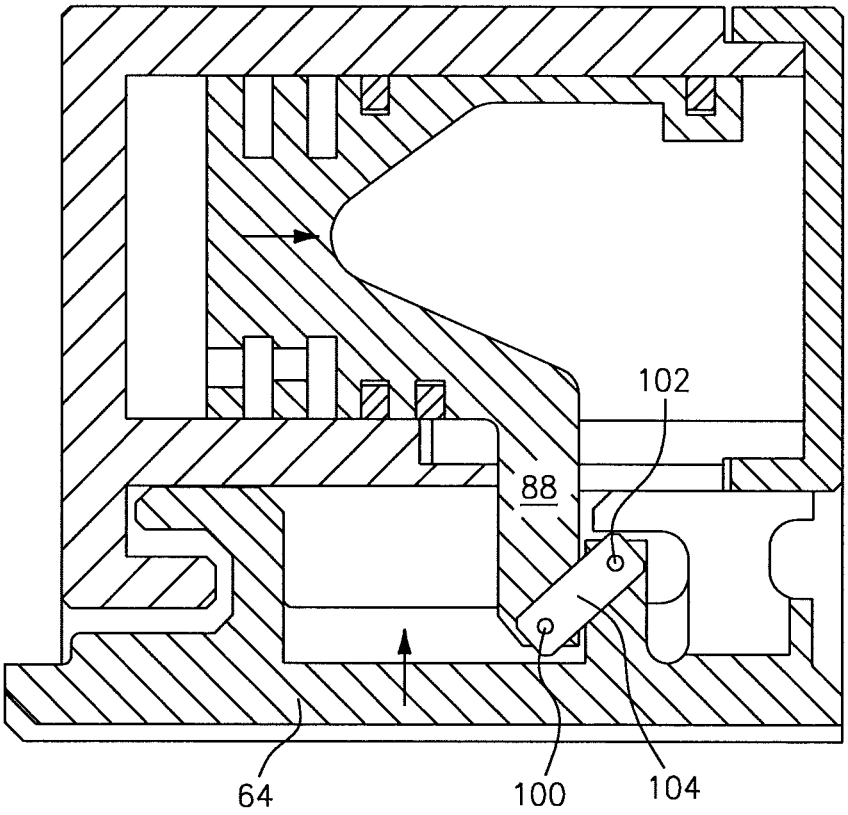
FIG. 10 is an enlarged partial sectional schematic view of one of a multiple of air seal segments of the rapid response active clearance control system of FIG. 9 in a radially expanded blade outer air seal position.

With reference to FIG. 9, in another disclosed non-limiting embodiment, the blade outer air seal lift lug 88' and respective lift lug 92' include pivot pins 100, 102, that are interconnected by a link 104 that translates axial movement of the annular piston 68 to radial movement of the multiple of blade outer air seal segments 64 between the radially contracted BOAS position (see FIG. 9) and a radially expanded BOAS position (see FIG. 10). That is, the link 104 rotates to translate the axial movement of the annular piston 68 to radial movement of the multiple of blade outer air seal segments 64. It should be appreciated that other interface mechanisms may additionally or alternatively be utilized to translate axial movement of the annular piston 68 to radial movement of the multiple of blade outer air seal segments 64.

Figure 11:
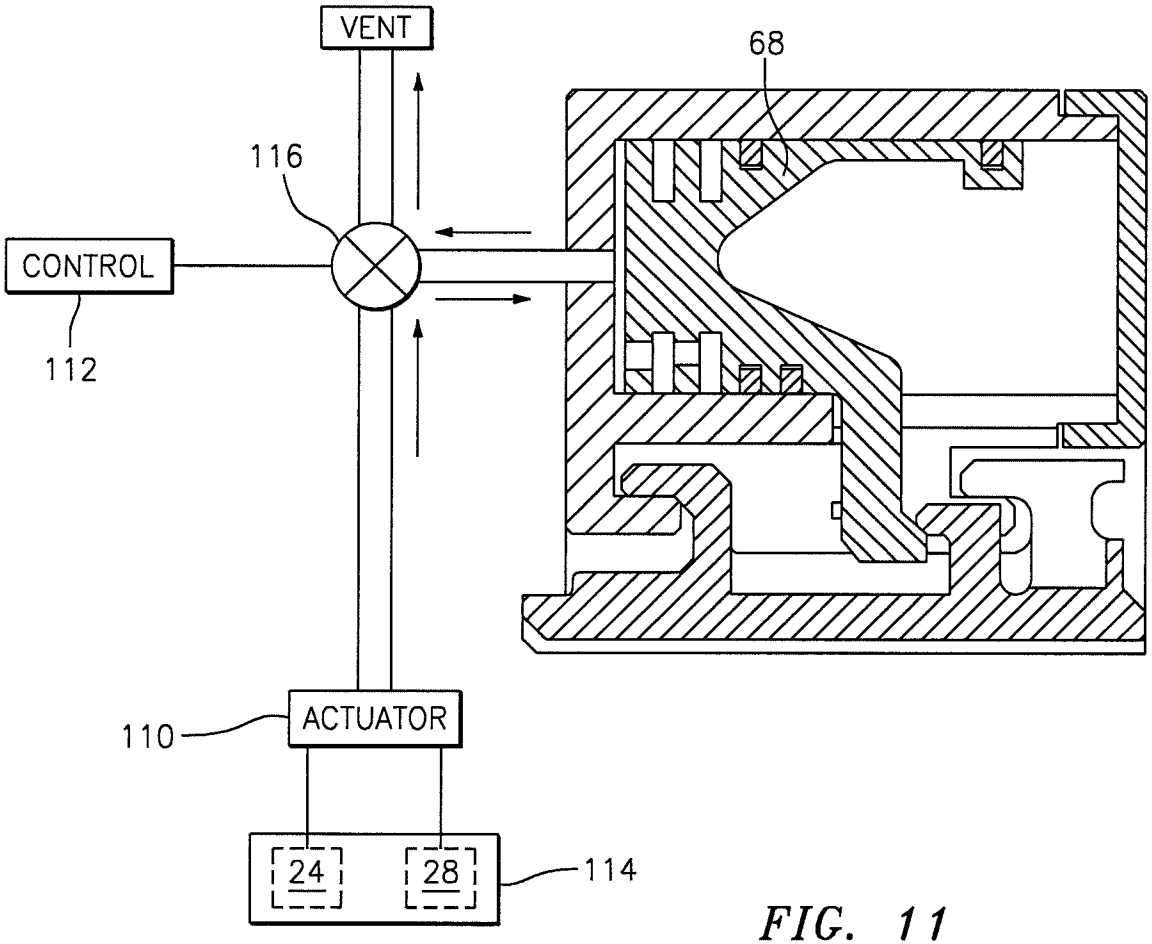
FIG. 11 is a schematic view of the rapid response active clearance control system.

With reference to FIG. 11, the annular piston 68 is driven by an actuator subsystem 110 (illustrated schematically) in response to a control subsystem 112 (illustrated schematically). Although the actuator subsystem 110 is disclosed herein as a pneumatic subsystem, it should be appreciated that other actuators such as mechanical or electrical may alternatively or additionally be utilized. It should be appreciated that various other control components such as sensors, actuators and other subsystems may be utilized herewith.

The actuator subsystem 110 in the disclosed non-limiting embodiment includes a pressure source 114 such as a bleed air source from within the compressor section 24 or turbine section 28. A three-way valve 116 operates in response to the control subsystem 112 to selectively supply air pressure such as bleed air into the full-hoop mount ring 70 to drive the annular piston 68 (to the right in the Figures) and thereby lift (upward in the Figures) each air seal segment 64 from the radially contracted BOAS position (see FIG. 6, 9) to the radially expanded BOAS position (see FIG. 7, 10).

The control subsystem 112 generally includes a control module that executes radial tip clearance control logic to thereby control the radial tip clearance relative the rotating blade tips 28T. The control module, for example, a portion of a flight control computer, an Electronic Engine Control, (EEC), a portion of a Full Authority Digital Engine Control (FADEC), a stand-alone unit or other system generally includes a processor, a memory, and an interface. The processor may be any type of known microprocessor having desired performance characteristics. The memory may be any computer readable medium which stores data and control algorithms such as logic as described herein. The interface facilitates communication with other components such as the three-way valve 116, thermocouple, pressure sensor, and others.

The three-way valve 116 also operates in response to the control subsystem 112 to selectively vent the air pressure from within the full-hoop mount ring 70 to release the air seal segments 64 toward the radially contracted BOAS position (see FIG. 6, 9) as the differential pressure from the core airflow inherently biases the air seal segments 64 toward the extended radially contracted BOAS position (see FIG. 6, 9). That is, the differential pressure from the core airflow inherently draws each air seal segment 64 from the radially expanded BOAS position (see FIG. 7, 10) to the contracted BOAS position (see FIG. 6, 9) when pressure is vented from the full-hoop mount ring 70 such that the annular piston 68 returns to a deactivated position (to the left in the Figures).

The annular piston 68 of the RRACC system 58 provides a unitary actuator which minimizes individual air seal segment 64 "hunting" for position on return as well as minimizes pneumatic subsystem complexity as only the single annular piston 68 needs be supplied. In one example, the RRACC system 58 has only about five moving parts—the annular piston 68 and four annular piston ring seals 86 to operate the multiple—forty shown—air seal segments 64. The single annular piston 68 thereby replaces forty separate pistons, seals, and lifting features that interface with the associated blade outer air seal segments for a total of about one hundred twenty parts per stage. The single annular piston 68 is also readily manufactured and assembled without significant—if any—engine case structure 36 penetration as well as provides an overall greater piston area which facilitates significant pulling force.

The use of the terms "a" and "an" and "the" and similar references in the context of description (especially in the context of the following claims) are to be construed to cover both the singular and the plural, unless otherwise indicated herein or specifically contradicted by context. The modifier "about" used in connection with a quantity is inclusive of the stated value and has the meaning dictated by the context (e.g., it includes the degree of error associated with measurement of the particular quantity). All ranges disclosed herein are inclusive of the endpoints, and the endpoints are independently combinable with each other. It should be appreciated that relative positional terms such as "forward," "aft," "upper," "lower," "above," "below," and the like are with reference to the normal operational attitude of the vehicle and should not be considered otherwise limiting.

Although the different non-limiting embodiments have specific illustrated components, the embodiments of this invention are not limited to those particular combinations. It is possible to use some of the components or features from any of the non-limiting embodiments in combination with features or components from any of the other non-limiting embodiments.

It should be appreciated that like reference numerals identify corresponding or similar elements throughout the several drawings. It should also be appreciated that although a particular component arrangement is disclosed in the illustrated embodiment, other arrangements will benefit herefrom.

The foregoing description is exemplary rather than defined by the limitations within. Various non-limiting embodiments are disclosed herein, however, one of ordinary skill in the art would recognize that various modifications and variations in light of the above teachings will fall within the scope of the appended claims. It is therefore to be appreciated that within the scope of the appended claims, the disclosure may be practiced other than as specifically described. For that reason the appended claims should be studied to determine true scope and content.

What is claimed is:

1. An active clearance control system for a gas turbine engine having a central longitudinal engine axis, the system comprising:

a single annular piston configured to move axially and that radially surrounds the central longitudinal engine axis and that includes an annular piston face that radially surrounds the central longitudinal engine axis and includes a multiple of piston lift lugs, wherein said multiple of piston lift lugs extend from said annular piston toward the central longitudinal engine axis a full-hoop mount ring that contains said single annular piston; and a pneumatic subsystem in communication with said full-hoop mount ring thru a valve to operate said single annular piston in response to a control subsystem.

2. The system as recited in claim 1, further comprising a multiple of blade outer air seal segments, each of said multiple of piston lift lugs engaged with one of said multiple of blade outer air seal segments.

3. The system as recited in claim 2, wherein said multiple of piston lift lugs translate axial movement of said single annular piston to radial movement of said multiple of blade outer air seal segments.

4. The system as recited in claim 3, wherein each of said multiple of blade outer air seal segments include a blade outer air seal lift lug engaged with one of said multiple of piston lift lugs at a ramped interface.

5. The system as recited in claim 3, wherein each of said multiple of blade outer air seal segments include a blade outer air seal lift lug engaged with one of said multiple of piston lift lugs through a link.

6. The system as recited in claim 1, further comprising a multiple of annular piston ring seals mounted to said single annular piston to seal said single annular piston within said full-hoop mount ring.

7. The system as recited in claim 6, wherein said single annular piston includes a multiple of piston faces.

8. The system as recited in claim 7, wherein said multiple of piston faces includes a first piston face, a second piston face and a third piston face, at least one piston face pass thru in said first piston face and said second piston face.

9. The system as recited in claim 8, wherein said first piston face, said second piston face and said third piston face are sealed by said multiple of annular piston ring seals.

10. The system as recited in claim 1, wherein said full-hoop mount ring supports a multiple of blade outer air seal segments.

11. The system as recited in claim 10, wherein each of said multiple of blade outer air seal segments include a lift lug engaged with one of said multiple of piston lift lugs.

12. The system as recited in claim 11, wherein each of said multiple of blade outer air seal segments includes a forward hook and an aft hook which respectively cooperate with a forward hook and an aft hook of said full-hoop mount ring.

13. The system as recited in claim 12, wherein said lift lug is located axially between said forward hook and said aft hook of each of said multiple of blade outer air seal segments.

14. The system of claim 1, where the valve comprises a three-way valve.

15. A method of active blade tip clearance control for a gas turbine engine having a central longitudinal engine axis, the method comprising:

translating axial movement of a single annular piston that radially surrounds the central longitudinal engine axis to radial movement of a multiple of blade outer air seal segments;

supporting each of the multiple of blade outer air seal segments with a full-hoop mount ring that contains the single annular piston; and pneumatically pressurizing the full-hoop mount ring to drive the single annular piston and lift the multiple of blade outer air seal segments.

16. The method as recited in claim 15, further comprising lifting the multiple of blade outer air seal segments with a ramp interface between a multiple of piston lift lugs that radially extend from the single annular piston and a lift lug on each of the multiple of blade outer air seal segments.

* * * * *